US006318502B1

(12) United States Patent
Unger

(10) Patent No.: US 6,318,502 B1
(45) Date of Patent: Nov. 20, 2001

(54) COMPRESSOR FOR PRODUCING OIL-FREE COMPRESSED AIR

(76) Inventor: Hans Unger, St. Benedikstr. 2, D-85716 Unterschleissheim (DE)

( * ) Notice: Subject to any disclaimer, the term of this patent is extended or adjusted under 35 U.S.C. 154(b) by 0 days.

(21) Appl. No.: 09/417,128

(22) Filed: Oct. 13, 1999

(30) Foreign Application Priority Data

Oct. 13, 1998 (DE) ..... 198 47 159

(51) Int. Cl.[7] ..... F01M 1/12; F04B 23/14

(52) U.S. Cl. ..... 184/6.16; 417/201; 417/269; 92/156

(58) Field of Search ..... 184/6.16, 6.17; 417/201, 269; 92/71, 153, 156; 60/456

(56) References Cited

U.S. PATENT DOCUMENTS

| | | | | |
|---|---|---|---|---|
| 3,458,114 | | 7/1969 | Catterson | 230/58 |
| 3,557,664 | | 1/1971 | Akaike et al. | 91/499 |
| 3,750,848 | * | 8/1973 | Nakayama | 184/6.16 |
| 3,930,758 | * | 1/1976 | Park | 184/6.16 |
| 4,070,136 | * | 1/1978 | Nakayama et al. | 184/6.16 |
| 5,062,773 | * | 11/1991 | Kawai et al. | 184/6.16 |
| 5,393,204 | * | 2/1995 | Kawahara | 184/6.16 |
| 5,647,266 | * | 7/1997 | Claas | 92/71 |
| 5,738,000 | * | 4/1998 | Forster | 417/269 |
| 5,752,809 | * | 5/1998 | Makino et al. | 417/269 |
| 5,772,407 | * | 6/1998 | Kato et al. | 184/6.16 |
| 5,915,928 | * | 6/1999 | Murse et al. | 92/71 |
| 5,941,161 | * | 8/1999 | Kimura et al. | 92/71 |
| 6,026,731 | * | 2/2000 | Hinrichs et al. | 417/269 |
| 6,030,184 | * | 2/2000 | Ikeda et al. | 417/269 |
| 6,120,259 | * | 9/2000 | Miyaji et al. | 417/269 |

FOREIGN PATENT DOCUMENTS

| | | |
|---|---|---|
| 4008871A1 | 10/1990 | (DE) . |
| 4230407A1 | 4/1993 | (DE) . |
| 4481042C2 | 8/1996 | (DE) . |
| 19616650C2 | 11/1996 | (DE) . |
| 19706066A1 | 11/1997 | (DE) . |
| 0318976A1 | 6/1989 | (EP) . |

OTHER PUBLICATIONS

EP International Search Report (dated Sep. 20, 2000).

* cited by examiner

*Primary Examiner*—David A. Bucci
*Assistant Examiner*—Chong H. Kim
(74) *Attorney, Agent, or Firm*—Crowell & Moring LLP

(57) ABSTRACT

In a compressor that can be used for supplying compressed air in motor vehicles and also for stationary systems, permanent oil filling is provided for cooling a compressor pressure area including a cylinder head and for lubricating a transmission area including a drive shaft and swash plate. The pressure area of the compressor that can be heated by the heat of compression and friction and the transmission area of the compressor are separated from one another by check valves with a delivery pump wheel being provided which transports the oil between the transmission area and the pressure area in such fashion that the oil that is heated in the pressure area is cooled in the transmission area. By cooling the oil in the transmission area, it is possible for a middle housing section of the compressor housing, as well as a housing section delimited by a cylinder head and receiving the piston arrangement, to be made of plastic.

15 Claims, 1 Drawing Sheet

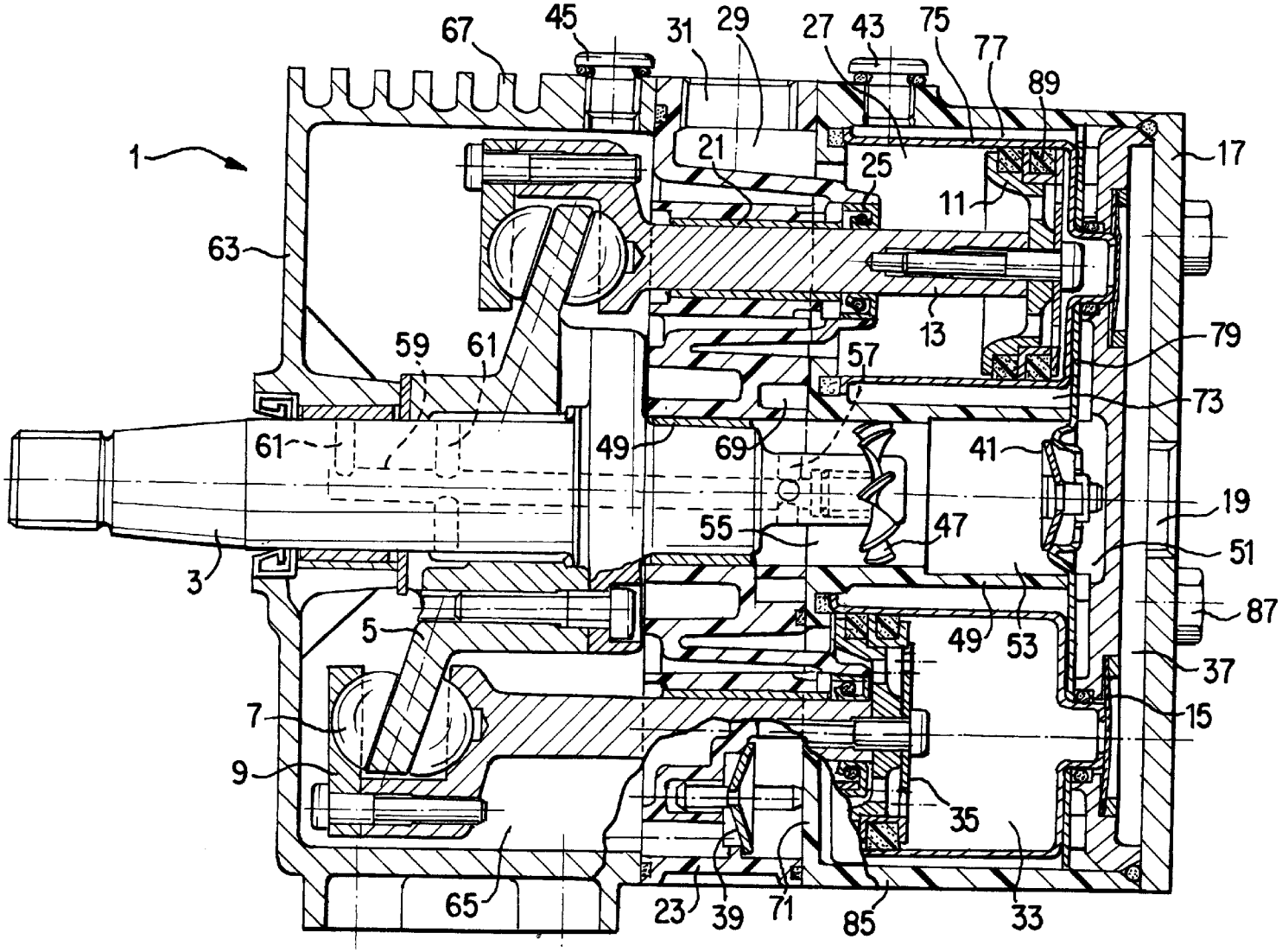
17
79
73
19
51
87
37
15
89
77
75
43
27
29
31
45
67
11
13
25
21
41
47
57
69
55
49
53
49
33
35
85
71
39
23
65
61
59
61
5
7
9
63
3
1

COMPRESSOR FOR PRODUCING OIL-FREE COMPRESSED AIR

BACKGROUND AND SUMMARY OF THE INVENTION

This application claims the priority of German application 198 47 159.9, filed in Germany on Oct. 13, 1998, the disclosure of which is expressly incorporated by reference herein.

The invention relates to a compressor for producing oil-free compressed air, with a transmission driven by a drive shaft, provided with a swash plate, and lubricated by oil, said transmission being connected by piston rods with pistons that act alternately against an oil-cooled cylinder head, with oil that serves to cool a pressure side of the compressor also being used to lubricate a transmission side.

Compressors of the above-noted type such as described in German Patent Document No. DE 197 06 066 A1 are especially suited for installation in motor vehicles. Provision is made for connecting the compressor to the lubricating oil and coolant circuits of the vehicle engine. However, in view of the high loads on vehicle engines and the fact that the maintenance of these media is not always guaranteed, it is not always advantageous for the compressor to be connected to these circuits. The cooling water and the lubricating oil are considerably heated by the engine. As a result, the cooling effect on the compressor is often very small. In addition, because it is installed in the immediate vicinity of the vehicle engine, the compressor is exposed to the heat radiated from the engine. Dry-running piston rings made of plastic are used in compressors to produce oil-free compressed air. Good cooling, however, is of critical importance for the service life of these piston rings.

Hence, a goal of the invention is to improve a compressor of the above-noted type species so that the heat is carried away from the hot zones into areas that are subject to less heat stress. It should also be possible to drive the compressor separately from the drive of a main drive, preferably by using a separate electric motor in such fashion that the compressor can be used universally. In particular, cooling should be provided such that production of oil-free compressed air remains guaranteed when using piston rings made of plastic.

According to the invention, the goal is achieved by providing a compressor of the above-noted type, wherein the oil that serves to cool and lubricate is specified by a quantity of oil that is encapsulated and permanent and is located inside a compressor housing, wherein an interior of the compressor is divided by check valves into a pressure area that surrounds the cylinder head and the piston arrangement, and a transmission area that contains the drive shaft and the swash plate, and wherein a delivery device is provided that pumps the oil depending on the flow direction specified by the check valves in a circuit between the pressure area and the transmission area.

By using a separate permanent lubricating oil and cooling oil circuit, the compressor can be located at any point in a vehicle for example; in this case, the compressor is driven by an electric motor. This in turn has the advantage that the compressor delivers a constant power independently of the rotational speed of the vehicle engine. In addition, the compressor can be started before the vehicle engine is started. This is advantageous when it is desirable for the vehicle to reach operating readiness quickly.

Integrated lubricating oil and cooling oil supply make the compressor especially suited even for installation in stationary air supply systems. The type of cooling with an encapsulated design for the compressor makes it possible to use plastic for important parts: This applies in particular to housing parts which can be clamped sandwich-fashion between the transmission area and the cylinder head.

Advantageous features of preferred embodiments of the invention are described herein and in the claims.

Other objects, advantages and novel features of the present invention will become apparent from the following detailed description of the invention when considered in conjunction with the accompanying drawings.

BRIEF DESCRIPTION OF THE DRAWINGS

The single drawing FIGURE shows a lengthwise sectional view of a compressor constructed according to a preferred embodiment of the invention.

DETAILED DESCRIPTION OF THE DRAWINGS

The axial piston compressor shown in the drawing with swash plate drive has an oil-lubricated drive 1 inside a multipartite housing, said drive consisting essentially of a swash plate 5 mounted on a drive shaft 3 and hemispheres 7 in bearing blocks 9. Drive 1 with a type of operation that is known of itself is used to perform straight-line movements of piston rods 13 bearing pistons 11 as drive shaft 3 turns. The pistons act alternately against check valves 15 of a cylinder head 17 in which a common pressure connection 19 is provided.

The piston rods 13 are mounted in bearing bushings 21 on the oil-lubricated transmission side of the compressor as explained below. The bearing bushings 21 extend on a partial circle at angular intervals from one another, parallel to the lengthwise axis of the compressor, through a middle housing section 23 on which oil-wiping sealing elements 25 facing the pistons are provided. Chambers 27 located at the back of pistons 11 are connected by an annular space 29 to a common intake chamber in which an intake connection 31 terminates. Each of the chambers 27 located on the back of pistons 11, acting as intake chambers, is separated by the piston from a pressure chamber 33, with each of the pistons having an intake valve 35. This intake valve forms the connection between the intake chamber and the pressure chamber during the intake stroke of the piston, with the valve opening during the leftward movement of the piston according to the drawing in such fashion that air passes through the intake connection 31, annular chamber 29, and chamber 27 into pressure chamber 33 and during the next movement which is directed toward the right as shown in the drawing, is expelled as intake valve 35 closes, through the check valve 15 shown in the sectional view and a common pressure chamber 37 into pressure connection 19.

The oil circuit of the compressor described above in terms of its essential parts is designed so that it transmits the heat developed mainly in the vicinity of the cylinder head and the compression chambers to a surface that is as large as possible with good conducting properties. According to the invention the compressor is divided into two volume areas that are constantly filled by different quantities of oil. These are two areas which are separated from one another by check valves 39 and 41 while the compressor is in the resting position. The check valves in a predetermined direction open during compressor operation, as explained below.

The quantity of oil required to operate the compressor is added to the compressor when it is manufactured. For this purpose, filling openings 43 and 45 are provided in the multipartite housing of the compressor. The right-hand area of the compressor, shown in the sectional view, is subjected to higher thermal stress. In this area, all of the coolant chambers discussed below are filled up to 100% with oil through filling opening 43. The left-hand area shown in the sectioned drawing, which is separated from the right-hand area by the check valves in the resting state, essentially constitutes the area of the transmission of the compressor. Here oil is added through filling opening 45 only up to a predetermined level; a greater oil volume would unnecessarily increase the splashing and hence the energy consumption of the compressor.

The parts for transporting the oil between the two areas of the compressor are explained below.

A pump wheel 47 is on drive shaft 3 of the compressor, said wheel extending at its outer circumference into a bushing 49 that extends from housing section 23. Under the suction effect of the pump wheel, the oil is drawn out of chamber 51 through check valve 41 into chamber 53 and passes through the pump wheel 47 into chamber 55 which constitutes the pressure side for chamber 53. The drive shaft that supports the pump wheel is provided in the vicinity of chamber 55 with a radial transverse bore 57 with which a continuous axial bore 59 in drive shaft 3 connects. Transverse bores 61 branch off at the left-hand end of bore 59. Under the pressure of the oil, the oil is delivered through the above-mentioned transverse bore 57 into bore 59 and then through transverse bores 61 into transmission 1 of the compressor. As a result of the rotating parts of the transmission, essentially the swash plate 5, the oil is flung against the wall of the left-hand housing section 63, and from there the oil runs down into oil sump 65. At this time, the oil gives up the heat absorbed in the hot area of the compressor to the housing section 63 in such fashion that the heat is lost to the outside air through the cooling ribs 67 shown. For this purpose, housing section 63 is made of a metal that is a good conductor of heat and provided with the above-mentioned cooling ribs. The oil simultaneously lubricates all bearing points in transmission 1.

Later in the process, the oil is delivered from oil sump 65 in the flow direction of check valve 39 and through the latter into an annular chamber 69. This annular chamber is connected through connecting bores (not shown) in partition 71 of the housing with annular chambers 73 which surround cylindrical bushings 75 of piston 11. The oil flows radially around the cylinder bushings outward into an annular chamber 77 and in this outer area flows around the outer edge of a guide panel 79. From there the oil flows around the sealed area of the check valves, and returns to chamber 51.

Guide panel 79 fulfills a number of functions. Firstly, it causes the oil to flow around the cylinder bushings 75 on all sides before it enters chamber 51. Another function of the guide panel is that it increases the available cooling area to carry away the heat. Hence, guide panel 79 rests flat on the particularly hot upper area of cylinder bushings 75, increasing their heat-conducting area. Finally, the guide panel separates chambers 51 and 53 in the center of the compressor and serves as a support or mount for check valve 41. The guide panel consists of a disk that covers almost the entire circumference of the compressor and is adapted to the shape of the cylinder head.

After passing the outer edge of the guide panel, the oil enters chamber 51 in the manner described above, said chamber being delimited in the central area by the cylinder head bottom, and is drawn into chamber 53 after passing check valve 41.

The intensive nature of the cooling explained above with reference to the flow of the oil allows the encapsulated design of the compressor. In the embodiment shown, the housing consists of three housing parts, namely housing section 63 that is made of die-cast material or a similar metal and housing sections 23 and 85 that preferably consist of plastic. The two housing sections 23 and 85 do not come into contact at any point with the hot compressed air so that they can be manufactured economically from plastic, and in similarly economical fashion the bearing bushings required for the drive shaft and piston rod can be injection-molded. The two housing sections 23 and 85 mentioned above and made of plastic are clamped in a so-called sandwich-fashion between parts that are made of metal, in other words between housing section 63 and cylinder head 17, with bolts 87 providing the clamping action.

Another advantage of the intensive cooling of cylinder bushings 75 consists in a lengthening of the service life of piston rings 89 of pistons 11 so that the piston rings for producing oil-free compressed air can be designed to run dry. This constitutes an important advantage of the flow guidance of the oil in the encapsulated compressor according to the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Compressor for producing oil-free compressed air, with a transmission driven by a drive shaft, provided with a swash plate, and lubricated by oil, said transmission being connected by piston rods with pistons that act alternately against an oil-cooled cylinder head, with oil that serves to cool a pressure side of the compressor also being used to lubricate a transmission side, wherein the oil that serves to cool and lubricate is specified by a quantity of oil that is encapsulated and permanent and is located inside a compressor housing, wherein an interior of the compressor is divided by check valves into a pressure area that surrounds the cylinder head and the piston arrangement, and a transmission area that contains the drive shaft and the swash plate, and wherein a delivery device is provided that pumps the oil depending on the flow direction specified by the check valves in a circuit between the pressure area and the transmission area.

2. Compressor according to claim 1, wherein the pressure area of the compressor and the transmission area each have a separate oil filling opening such that the pressure area of the compressor can be filled preferably up to 100% while the transmission area can be filled with a partial amount.

3. Compressor according to claim 1, wherein the delivery device for circulating the oil is formed by a pump wheel which is fastened to an end of the drive shaft inside the compressor housing and transports the oil between the pressure area and the transmission area as a function of the opening direction provided through the check valves.

4. Compressor according to claim 3, wherein the pump wheel on the end of the drive shaft operates within a bushing that extends from a central housing section of the compressor to the pressure area of the latter, said bushing surrounding a first chamber, wherein said first chamber is delimited from the cylinder head by a check valve that opens in a direction of pump wheel, wherein a second chamber located on a pressure side of the pump wheel is connected by transverse bores and an axial bore that is closed at a head end and passes though the drive shaft axially centrally, further transverse bores branching off radially from the axial bore and connecting with the interior of a housing section that holds an oil sump, wherein the oil sump is connected by at least one check valve with an annular chamber that is located in a middle housing section, said annular chamber being connected to a further chamber of the pressure area that surrounds cylinder bushings of the piston, and wherein the further chamber that surrounds the cylinder bushings is connected by links in an area of the cylinder head to a chamber which is separated from the first chamber that receives the pump wheel by the check valve.

5. Compressor according to claim 1, wherein the housing of the compressor comprises a plurality of housing sections, including a housing section made of metal and containing the transmission, a central housing section made of plastic that supports bearing bushings of the piston rods, and a housing section made of plastic that surrounds the pressure area of the compressor and is delimited on one side by the cylinder head.

6. Compressor according to claim 5, wherein the housing sections made of plastic are clamped sandwich-fashion between the housing section made of metal and the cylinder head.

7. Compressor according to claim 2, wherein the housing of the compressor comprises a plurality of housing sections, including a housing section made of metal and containing the transmission, a central housing section made of plastic that supports bearing bushings of the piston rods, and a housing section made of plastic that surrounds the pressure area of the compressor and is delimited on one side by the cylinder head.

8. Compressor according to claim 7, wherein the housing sections made of plastic are clamped sandwich-fashion between the housing section made of metal and the cylinder head.

9. Compressor according to claim 3, wherein the housing of the compressor comprises a plurality of housing sections, including a housing section made of metal and containing the transmission, a central housing section made of plastic that supports bearing bushings of the piston rods, and a housing section made of plastic that surrounds the pressure area of the compressor and is delimited on one side by the cylinder head.

10. Compressor according to claim 9, wherein the housing sections made of plastic are clamped sandwich-fashion between the housing section made of metal and the cylinder head.

11. Compressor according to claim 4, wherein the housing of the compressor comprises a plurality of housing sections, including a housing section made of metal and containing the transmission, a central housing section made of plastic that supports bearing bushings of the piston rods, and a housing section made of plastic that surrounds the pressure area of the compressor and is delimited on one side by the cylinder head.

12. Compressor according to claim 11, wherein the housing sections made of plastic are clamped sandwich-fashion between the housing section made of metal and the cylinder head.

13. Compressor according to claim 1, wherein the pressure area of the compressor and the transmission area each have a separate oil filling opening that can be filled separately with different oil filling levels.

14. Compressor according to claim 3, wherein the pressure area of the compressor and the transmission area each have a separate oil filling opening that can be filled separately with different oil filling levels.

15. Compressor according to claim 5, wherein the pressure area of the compressor and the transmission area each have a separate oil filling opening that can be filled separately with different oil filling levels.

* * * * *